US005541624A

United States Patent [19]

Cooke et al.

[11] Patent Number: 5,541,624

[45] Date of Patent: Jul. 30, 1996

[54] IMPULSE INK JET APPARATUS EMPLOYING INK IN SOLID STATE FORM

[75] Inventors: Theodore M. Cooke, Danbury; William J. DeBonte, Kent, both of Conn.

[73] Assignee: Dataproducts Corporation, Simi Valley, Calif.

[21] Appl. No.: 328,384

[22] Filed: Oct. 24, 1994

Related U.S. Application Data

[63] Continuation of Ser. No. 719,698, Jun. 25, 1991, abandoned, which is a continuation of Ser. No. 522,072, May 10, 1990, abandoned, which is a continuation of Ser. No. 342,633, Apr. 20, 1989, abandoned, which is a continuation of Ser. No. 945,112, Dec. 22, 1986, abandoned, which is a continuation of Ser. No. 660,656, Oct. 15, 1984, Pat. No. 4,631,557.

[51] Int. Cl.[6] ..... B41J 2/47

[52] U.S. Cl. ..... 346/141; 347/86; 347/99

[58] Field of Search ..... 347/88, 86, 85, 347/84, 99

[56] References Cited

U.S. PATENT DOCUMENTS

| | | |
|---|---|---|
| 2,890,125 | 6/1959 | Mange . |
| 3,247,519 | 4/1966 | Sihvonen . |
| 3,282,709 | 11/1966 | Ehrhardt et al. . |

(List continued on next page.)

FOREIGN PATENT DOCUMENTS

| | | | |
|---|---|---|---|
| 097823 | 1/1984 | European Pat. Off. . | |
| 0099682 | 2/1984 | European Pat. Off. . | |
| 0123523 | 10/1984 | European Pat. Off. . | |
| 0147257 | 7/1985 | European Pat. Off. . | |
| 0181198 | 5/1986 | European Pat. Off. . | |
| 0037195 | 10/1991 | European Pat. Off. . | |
| 53-95027 | 8/1978 | Japan . | |
| 56-113462A | 2/1980 | Japan . | |
| 55-54368 | 4/1980 | Japan . | |
| 56-113462 | 9/1981 | Japan . | |
| 56-113472 | 9/1981 | Japan . | |
| 57-49072 | 10/1982 | Japan . | |
| 2111523A | 7/1983 | Japan . | |
| 58-116162 | 7/1983 | Japan | 346/140 PD |
| 58-208062 | 12/1983 | Japan . | |
| 5987162 | 5/1984 | Japan . | |
| 1424722 | 2/1976 | United Kingdom . | |
| 2111523 | 12/1982 | United Kingdom . | |

OTHER PUBLICATIONS

Abstract No. 702458/39 "Ink for hot ink jet recording process," Mar. 3, 1978.

Abstract No. J55145–774 "Low softening point ink for ink jet recording," May 2, 1979.

Abstract No. 77/17,758 "Magnetic Ink Jet Printing Process," Sep. 9, 1978.

Abstract No. 80083B/44 "Recording medium for ink jet recording process," Mar. 15, 1978.

Abstract No. 107587 "Inks for ink–jet recording," May 17, 1974.

Abstract No. 06955B/04 "Oily ink compsn. for stamping, recording, jet printing, etc.," May 18, 1977.

Sweet, "High–Frequency Oscillography With Electrostatically Deflected Ink Jets", Stanford Electronics, Technical Report No. 1722–1, Mar. 1964.

Sweet, "High–Frequency Recording With Electrostatically Deflected Ink Jets", The Review of Scientific Instruments, vol. 36, No. 2, pp. 131–136, Feb. 1965.

Hendriks, "Ink Spitter For Hot Melt Ink", IBM Technical Disclosure Bulletin, vol. 26, No. 3A, Aug. 1983.

Abstract No. K5010 C/44 "High speed recording equipment drop generator", Oct. 23, 1980.

(List continued on next page.)

*Primary Examiner*—Mark J. Reinhart

*Attorney, Agent, or Firm*—Woodcock Washburn Kurtz Mackiewicz & Norris

[57] ABSTRACT

A demand ink jet employs removable cartridges of hot melt ink. When the temperature of the ink within the cartridge is raised, the ink melts and drains from the cartridge into the supply system.

4 Claims, 2 Drawing Sheets

U.S. PATENT DOCUMENTS 3,282,853 11/1966 Bennett .
3,330,673 7/1967 Voet et al. .
3,353,974 11/1967 Trimble et al. .
3,369,253 2/1968 Sihvonen .
3,421,910 1/1969 Gilson et al. .
3,596,285 7/1971 Gottwald .
3,653,932 4/1972 Berry et al. .
3,715,219 2/1973 Kurz et al. .
3,846,141 11/1974 Ostergren et al. .
3,994,736 11/1976 Hertz et al. .
4,005,237 1/1977 Panken .
4,018,728 4/1977 Priest .
4,021,252 5/1977 Banczak et al. .
4,038,297 7/1977 Rodenberg et al. .
4,066,585 1/1978 Schepp et al. .
4,069,179 1/1978 Jones .
4,106,030 8/1978 Hampton et al. .
4,108,671 8/1978 Richlin .
4,136,076 1/1979 Daniels .
4,150,997 4/1979 Hayes .
4,153,467 5/1979 Yano et al. .
4,165,399 8/1979 Germonprez .
4,171,981 10/1979 Austin et al. .
4,176,361 11/1979 Kawada et al. .
4,178,595 12/1979 Jinnai et al. .
4,197,135 4/1980 Bailey et al. .
4,218,252 8/1980 Yokoyama .
4,238,807 12/1980 Bovio et al. ..... 346/140 R
4,243,994 1/1981 Kobayashi et al. ..... 346/140
4,248,746 2/1981 Greiner .
4,250,512 2/1981 Kattner et al. .
4,251,824 2/1981 Hara et al. .
4,273,847 6/1981 Lennon et al. .
4,279,653 7/1981 Makishima et al. ..... 106/22
4,281,329 7/1981 Yano et al. ..... 346/1.1
4,296,421 10/1981 Hara et al. .
4,303,445 12/1981 Whitfield et al. .
4,312,009 1/1982 Lange .
4,332,946 6/1982 Venkataramu et al. .
4,337,183 6/1982 Santiago .
4,343,653 8/1982 Beach et al. .
4,353,078 10/1982 Lee et al. .
4,361,843 11/1982 Cooke et al. .
4,381,946 5/1983 Vehara et al. .
4,389,657 6/1983 McMahon .
4,390,369 6/1983 Merritt et al. .
4,395,287 7/1983 Kobayashi et al. ..... 106/20
4,396,429 8/1983 Matsumoto et al. .
4,400,215 8/1983 Cooke et al. .
4,409,040 10/1983 Tabayashi et al. .
4,419,677 12/1983 Kasugayama et al. .
4,421,559 12/1983 Owatari .
4,422,085 12/1983 Sumitomo et al. .
4,426,227 1/1984 Keeling et al. .
4,443,820 4/1984 Mutch et al. .
4,459,601 7/1984 Howkins .
4,472,537 9/1984 Johnson et al. .
4,475,113 10/1984 Lee et al. .
4,484,948 11/1984 Merritt et al. .
4,490,731 12/1984 Vaught ..... 346/140 PD
4,509,059 4/1985 Howkins .
4,531,976 7/1985 Lin .
4,537,631 8/1985 Cooke et al. .
4,539,570 9/1985 Moore .
4,550,324 10/1985 Tamaru et al. ..... 346/76
4,597,794 7/1986 Ohta et al. ..... 106/20
4,631,557 12/1986 Cooke ..... 346/140 PD
4,659,383 4/1987 Lin et al. .
4,758,276 7/1988 Lin et al. .
4,822,418 4/1989 Lin et al. .

OTHER PUBLICATIONS

Abstract No. J3503 C/39 "Ink jet printer with uniform droplets", Apr. 2, 1979.
Abstract No. 35067C/20 "Ink jet recording head–with heating element at junction of liquid inlet and inclined expulsion zone", Dec. 28, 1978.
Abstract No. L6528 C/49 "Print head for ink jet printer", Nov. 27, 1980.
Romano, "Digital Technologies will become more commonplace in various graphic operations", American Printer and Lithographer, p. 58, No. 1979.
"It's Sunnyside Up For Ink Jet Printing", American Printer and Lithographer, pp. 56–58, Sep. 1980.
Abstract No. 43987C/25 "Non–impact recording process," Oct. 31, 1978.
Abstract No. 45784C/26 "Quick–drying ink for ink jet recording," Nov. 10, 1978.
Abstract No. 47097C/27 "Quick drying ink for ink jet recording," Nov. 13, 1978.
Abstract No. 89298X/48 "Ink compsns. for ink injection type recording appts.," Nov. 28, 1973.
Abstract No. 95:229337 "Preparation of hectragraphic plates," 74–Radiation Chem., Photochem., vol. 95, p. 643 (1981).
The Condensed Chemical Dictionary, 10th Edition, p. 98 (1981).
Bennett, H., "Industrial Waxes," vol. 1 (Chapters 1, 2, 10, 11) and vol. 2 (Chapter 2, pp. 81–91, 167–173, 236–237), Chemical Publishing Co., Inc., New York (1975).
CRC Handbook of Chemistry and Physics, p. C–283, 1979–80 Edition.
Lloyd Owens, "New Ink–Writing Methods for Graphic Recording", Instruments and Control Systems, vol. 38, Jul. '65.

IMPULSE INK JET APPARATUS EMPLOYING INK IN SOLID STATE FORM

This is a continuation of application Ser. No. 07/719,698, filed Jun. 25, 1991, abandoned, which in turn is a Rule 62 FWC of Ser. No. 522,072 filed May 10, 1990 abandoned which in turn is a FWC of Ser. No. 342,633 filed Apr. 20, 1989, abandoned, which in turn is a continuation of Ser. No. 945,112 filed Dec. 22, 1986, abandoned, which in turn is a continuation of Ser. No. 660,656 filed Oct. 15, 1984 now U.S. Pat. No. 4,631,557 issued Dec. 23, 1986.

BACKGROUND OF THE INVENTION

This invention relates to an ink jet wherein the ink employed with the jet is of the phase change type which may be referred to as hot melt ink.

A phase change or hot melt ink of the type utilized in an ink jet is characteristically solid at room temperature. When heated, the ink will melt to a consistency so as to be jettable. A hot melt ink jet apparatus and method of operation are disclosed in copending application Ser. No. 610,627, filed May 16, 1984, now abandoned in favor of co-pending application Ser. No. 938,334 filed Dec. 4, 1986 which is assigned to the assignee of this invention. The hot melt ink may be jetted from a variety of apparatus including those disclosed in the aforesaid copending application.

When employing ink in a liquid state, the delivery of the ink is, of course, dictated by the liquid state. Typically, the ink is contained within a closed vessel of some sort prior to delivery to the ink jet. When employing hot melt ink, the solid state nature of the ink suggests different ink delivery techniques.

SUMMARY OF THE INVENTION

It is an object of this invention to provide a hot melt ink delivery system for an impulse ink jet apparatus wherein handling of the ink is minimized.

It is a further object of this invention to provide a hot melt ink delivery system wherein the ink may be easily supplied to the impulse ink jet apparatus.

It is a further object of this invention to provide a hot melt ink delivery system which lends itself to use in an array of ink jets.

It is a still further object of this invention to provide an ink delivery system which may employ different colors of ink in an array of impulse ink jets.

It is a still further object of this invention to provide an impulse ink jet apparatus wherein the conduction of heat to the ink in the system is facilitated.

In accordance with these an other objects of the invention, ink is delivered in solid state form to an impulse ink jet apparatus at a position spaced from an impulse ink jet. The jet apparatus at a position spaced from an impulse ink jet. The ink is melted at the position so as to change the ink from a solid state to a liquid state. The ink is flowed in the liquid state from the position to the impulse ink jet and droplets of ink are ejected from the impulse ink jet on demand.

DETAILED DESCRIPTION OF A PREFERRED EMBODIMENT

Figure 1:
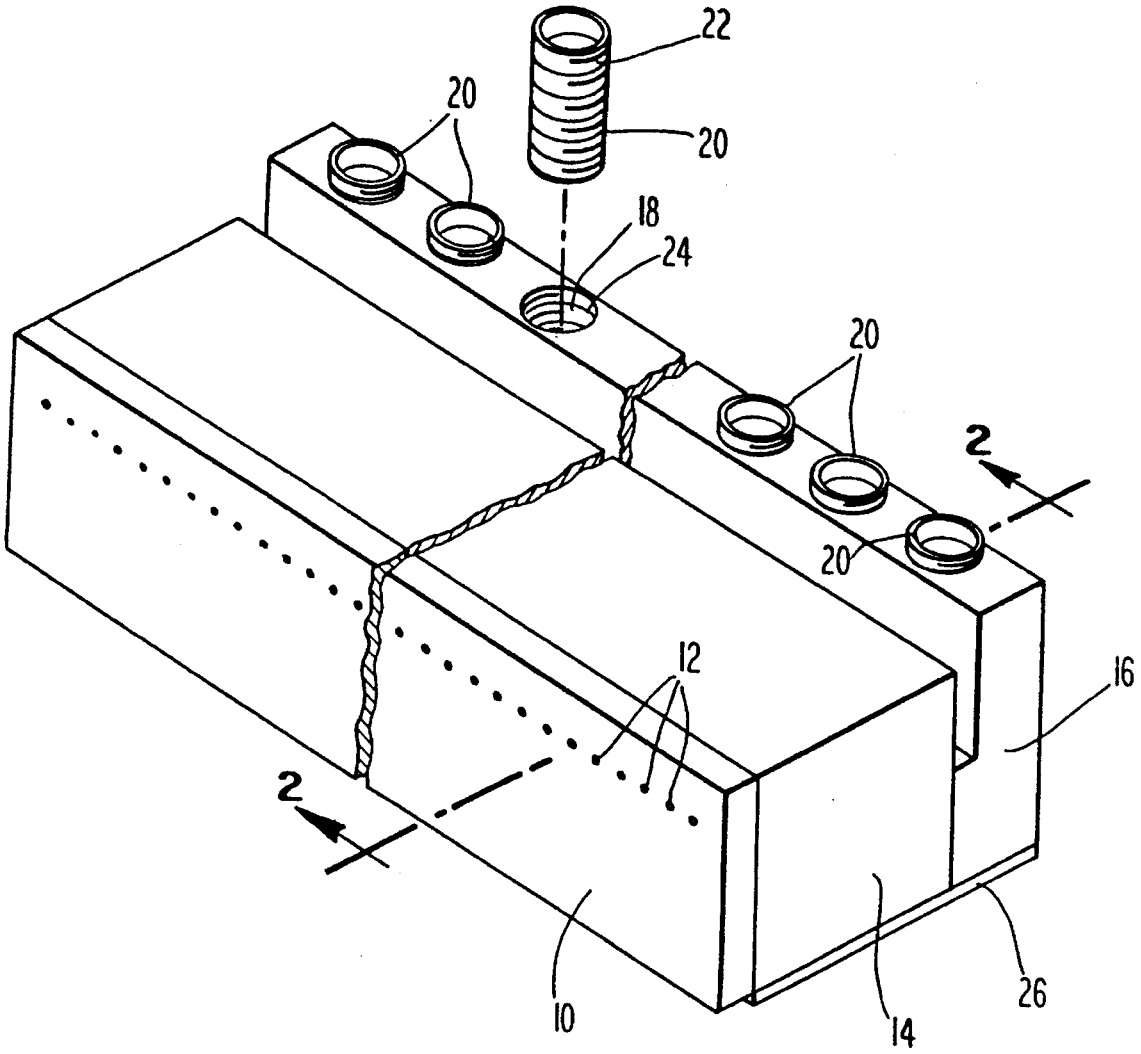
FIG. 1 is a perspective view of an ink jet apparatus constructed in accordance with this invention.

Referring to FIG. 1, a demand ink jet apparatus is disclosed comprising a chamber plate 10 having an array of orifices 12 for ejecting droplets of ink. An intermediate plate 14 is located between the chamber plate 12 and an ink supply plate 16.

In accordance with one important aspect of the invention, the supply plate 16 includes receptacles 18 which receive cylindrical cartridges 20. The receptacles 18 include threads 22 which mate with threads 24 in the receptacle 18 for engaging and securing the cartridges 20 in place.

In accordance with another important aspect of the invention, the ink within the cartridges 20 is maintained in a solid state in a substantially cylindrical block form prior to insertion into the receptacles 18. After insertion, the block of solid state ink within the cartridge 20 is heated so as to permit the ink to flow from the cartridge 20 which serves as a melting location to the ink jets including the chambers housed within the plate 10. This heating is accomplished, in accordance with one important aspect of this invention, by a heating plate 26 which is thermally coupled to and located below the chamber plate 10, the intermediate plate 14 and the supply plate 16.

Figure 2:
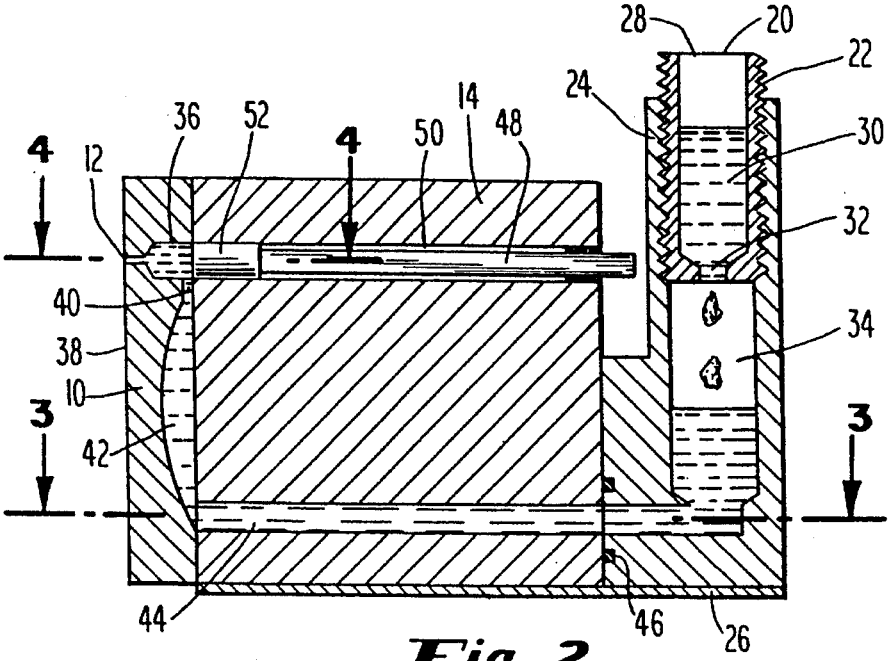
FIG. 2 is a sectional view of the apparatus of FIG. 1 taken along line 2—2.

Reference will now be made to FIG. 2 for a fuller explanation of the ink supply system as well as the ink jet. Each cartridge 20 which is essentially tubular but partially closed to form a cup has an open end 28 so as to permit the filling of the cartridge 20 with ink 30. As shown in FIG. 2, the ink 30 has undergone a phase change by virtue of the heating supplied by the plate 26. However, prior to heating, the ink 30 was in the solid state such that ink would not flow or drip from an opening 32 in the bottom of the cup-like cartridge. Once the heating of the cartridge 20 takes place to a point above the melting point of the ink 30, the ink 30 becomes sufficiently liquid so as to drain into a reservoir column 34 by virtue of gravity flow.

Referring again to FIG. 2, details of the chamber plate 10 are disclosed. The chamber plate 10 includes a plurality of chambers 36 having orifices 12 communicating with the face 38 of the plate 10. Each chamber 36 has an inlet opening 40 which is supplied from a dish-shaped plenum 42. The ink in the plenum 42 is supplied from the reservoir 34 by an ink flow transfer path 44 which extends through the intermediate plate 14.

As will be appreciated from FIG. 2, by utilizing a heat conductive material for the plates 10, 14 and 16, the temperature throughout the ink travel path may be made substantially constant, i.e., there is very little temperature gradient across the device from the melting location in the cartridge 20 through the supply location to the chamber 36. Suitable heat conductive materials which may be employed for the plates 10, 14 and 16 include but are not limited to stainless steel, copper and aluminum as disclosed in copending application Ser. No. 661,924, filed Oct. 16, 1984, which is assigned to the assignee of this invention and incorporated herein by reference. All such materials assure the conducting of heat in a substantially uniform way to all locations of ink. It may also be desirable to provide for separate heating of the ink supply and the jets are disclosed in copending application Ser. No. 661,029, filed Oct. 15, 1984, which is assigned to the assignee of this invention and incorporated herein by reference.

In accordance with another important aspect of the invention, it will be appreciated that the ink flow transfer path 44 is relatively short and that the entire structure, although comprising separate plates, has been integrated. This assures that the temperature at all locations will be substantially uniform and minimizes the risk of an ink freeze up at some location; i.e., conversion to a solid state.

FIG. 2 also reveals the use of a sealing ring 46 adjacent the ink flow transfer path 44 between the intermediate plate 14 and the supply plate 16. FIG. 2 also shows the details of the transducer drive for the ink jet including an elongated transducer member 48 mounted within an elongated opening 50 in the plate 14. The end of the transducer 48 adjacent the chamber 36 abuts a foot 52 for transmitting the movement of the transducer to the chamber 36. The transducer 48 is, of course, driven by a pair of conductors on either side of the member 48. Details concerning such a ink jet chamber may be found in copending application Ser. No. 576,582, filed Feb. 3, 1984 as well as U.S. Pat. No. 4,459,601, and copending application Ser. No. 661,794, filed Oct. 15, 1984, which are assigned to the assignee of this invention and incorporated herein by reference.

Figure 3:
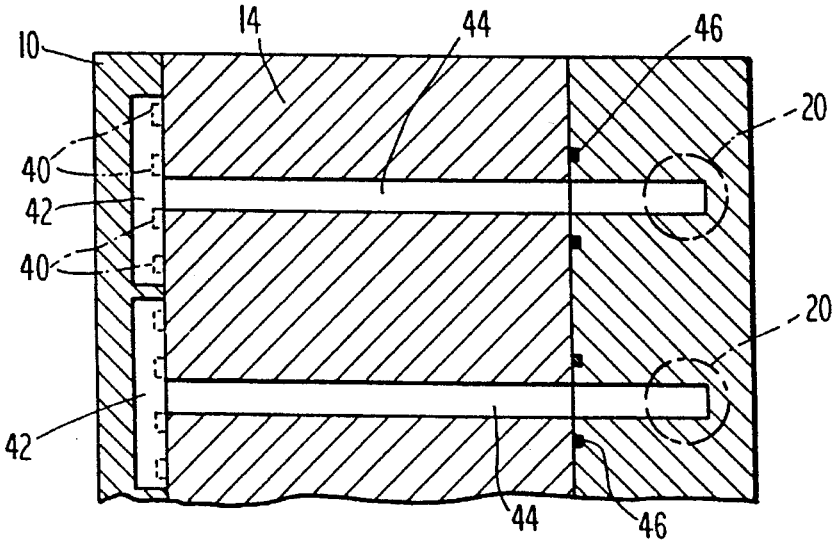
FIG. 3 is a sectional view of the apparatus of FIGS. 1 and 2 taken along line 3—3 of FIG. 2.
Figure 4:
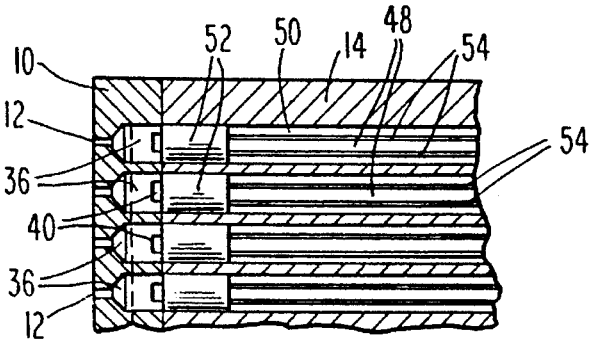
FIG. 4 is a sectional view of the apparatus of FIGS. 1 through 3 taken along line 4—4 of FIG. 2.

Referring to FIGS. 3 and 4, the nature of the array of ink jets depicted in FIG. 1 may be better appreciated. As shown in FIG. 3, a plurality of flow transfer paths 44 are employed where each transfer path 44 supplies a separate plenum 42 coupled to inlets 40 for four separate jets including chamber 36 as depicted in FIG. 4. As also shown in FIG. 4, electrodes 54 are applied to opposite sides of the transducer members 48 so as to permit the application of voltages across the transducers 48.

With the configuration shown in FIGS. 3 through 4, it is possible to employ cartridges 20 which carry ink of different colors in the solid state. As shown in FIG. 1, by utilizing six different cartridges, it is possible to employ six different colors of ink where four jets are associated with each color.

Although a particular embodiment of the invention has been shown and described, it will be understood that other embodiments and modifications will occur to those of ordinary skill in the art which will fall within the true spirit and scope of the invention as set forth in the appended claims.

It will be appreciated that the cartridge 20 may be mounted lower, such that the level of ink always remains below the chamber 36. This assures that all of the ink may be melted at one time without creating a positive head of pressure.

It will be appreciated that the blocks of ink described herein may take a variety of shapes and forms and may be carried in a variety of cartridges as disclosed in copending applications Ser. No. 660,657, filed Oct. 15, 1984 (now abandoned), Ser. No. 661,922, filed Oct. 16, 1984, Ser. No. 660,655, filed Oct. 15, 1984, now U.S. Pat. No. 4,593,292, issued Jun. 3, 1986, Ser. No. 661,701, filed Oct. 16, 1984 (now abandoned), and Ser. No. 661,034, filed Oct. 15, 1984, now U.S. Pat. No. 4,609,924, issued Sep. 2, 1986, all of which are assigned to the assignee of this invention and incorporated herein by reference. The preferred ink is described in U.S. Pat. No. 4,390,369 and pending U.S. applications Ser. No. 610,627, filed May 16, 1984, Ser. No. 565,124, filed Dec. 23, 1983 and Ser. No. 644,542, filed Aug. 27, 1984, now U.S. Pat. No. 4,659,383, issued Apr. 21, 1987, all of which are assigned to the assignee of this invention and incorporated herein by reference.

What is claimed is:

1. An impulse ink jet apparatus comprising:

an ink jet means for ejecting droplets of ink in the liquid state;

receptacle means for receiving ink in the solid state delivered to said receptacle means;

heater means for applying heat to said receptacle means for converting the ink in the solid state to ink in the liquid state in said receptacle means; and coupling means for flowing the ink in the liquid state through a transfer flow path from said receptacle means to said ink jet means.

2. The ink jet apparatus of claim 1 further comprising:

reservoir means coupled to and between said receptacle means and said coupling means for establishing a liquid reserve of ink in the liquid state before flowing the ink to said ink jet means through said coupling means.

3. The ink jet apparatus of claim 1 further comprising:

cartridge means containing said ink in the solid state for delivery to said receptacle means.

4. The ink jet apparatus of claim 1 wherein said ink jet means comprises an impulse ink jet for ejecting droplets of ink on demand.

* * * * *